United States Patent [19]

Bullivant et al.

[11] Patent Number: 4,819,015

[45] Date of Patent: Apr. 4, 1989

[54] ANTI-THEFT PRODUCT RACK AND METHOD

[75] Inventors: Kenneth W. Bullivant, Chadds Ford, Pa.; Sam C. Falco, Winston Salem, N.C.

[73] Assignee: K-Tron International, Inc., Pitman, N.J.

[21] Appl. No.: 245,947

[22] Filed: Sep. 19, 1988

Related U.S. Application Data

[63] Continuation of Ser. No. 157,985, Feb. 19, 1988, abandoned, which is a continuation of Ser. No. 874,159, Jun. 13, 1986, abandoned.

[51] Int. Cl.[4] ..... G08B 13/14

[52] U.S. Cl. ..... 340/568; 340/666; 364/479; 364/568

[58] Field of Search ..... 340/568, 666, 825.35, 340/870.05; 364/479, 568; 177/25, 45; 194/216–217; 453/17, 58; 221/2, 6

[56] References Cited

U.S. PATENT DOCUMENTS

| | | | |
|---|---|---|---|
| 2,492,257 | 6/1946 | Barton | 177/48 |
| 2,683,260 | 7/1954 | Lavelle | 340/666 X |
| 2,936,163 | 5/1960 | Foster | 177/124 |
| 3,155,182 | 11/1964 | Rackman | 177/45 |
| 3,750,158 | 7/1973 | Anastassakis | 340/568 X |
| 3,858,181 | 12/1974 | Goldsby et al. | 340/870.05 |
| 3,958,527 | 5/1976 | Iannacone | 177/45 X |
| 3,982,238 | 9/1976 | Byers | 340/666 X |
| 4,108,363 | 8/1978 | Susumu | 177/25 X |
| 4,124,840 | 11/1978 | Kobayashi | 340/501 |
| 4,142,238 | 2/1979 | Brandt et al. | 340/526 X |
| 4,155,457 | 5/1979 | Wilbert | 340/568 X |
| 4,157,738 | 6/1979 | Nishiguchi et al. | 177/1 |
| 4,195,287 | 3/1980 | McCoy et al. | 340/521 |
| 4,208,630 | 6/1980 | Martinez | 455/75 X |
| 4,218,672 | 8/1980 | Weisshappel et al. | 340/52 R |
| 4,295,133 | 10/1981 | Vance | 340/573 |
| 4,325,441 | 4/1982 | Nakatani et al. | 177/25 |
| 4,412,292 | 10/1983 | Sedam et al. | 364/479 |
| 4,512,428 | 4/1985 | Bullivant | 364/568 X |
| 4,528,553 | 7/1985 | Hastings et al. | 340/526 |
| 4,581,605 | 4/1986 | Vogt | 340/525 |
| 4,591,069 | 5/1986 | Stewart | 221/6 |
| 4,598,378 | 7/1986 | Giacomo | 364/479 |
| 4,611,197 | 9/1986 | Sansky | 340/522 |
| 4,629,018 | 12/1986 | Erb | 177/47 |

FOREIGN PATENT DOCUMENTS

| | | |
|---|---|---|
| 0091274 | 10/1983 | European Pat. Off. . |
| 2614766 | 10/1977 | Fed. Rep. of Germany . |
| 49-44475 | 4/1974 | Japan . |
| 59-64073 | 4/1984 | Japan . |
| 1267630 | 5/1970 | United Kingdom . |
| 2027914 | 2/1980 | United Kingdom . |
| 2076979 | 12/1981 | United Kingdom . |

*Primary Examiner*—Glen R. Swann, III
*Assistant Examiner*—Thomas J. Mullen, Jr.
*Attorney, Agent, or Firm*—Parkhurst, Oliff & Berridge

[57] ABSTRACT

The anti-theft product rack continuously monitors the weight of the rack including individual product units. When a weight deviation is detected, it is characterized as either a disturbance or as the removal of one or more product units. An alarm is sounded if the rack is continuously disturbed for a programmable number of continuous weight sensing cycles, or if a programmable number of disturbances occur during a programmable period of time. In addition, an alarm is sounded if the number of product units detected as being removed at one time exceeds a programmable limit. Finally, if the number of detected product units removed exceeds a programmable number during a programmable period of time, an alarm is sounded. The product display rack presents no physical barriers to product removal and requires no intervention of sales personnel for product removal. Thus, the present invention presents an aesthetically pleasing product rack while providing a high degree of protection against shoplifting or employee theft.

104 Claims, 7 Drawing Sheets

A

68
MOTFLAG1=0?
YES
NO
71
MOTCNT=0
69
MOTCNT=MOTCNT+1
MOTCNT>K2?
YES
NO
72
ALARM=2
73
MOTCNT=0
74
SOUND ALARM (FIG. 5)
76
77
MOTFLAG1=1 AND MOTFLAG2=0?
YES
NO
78
PREWT=WTRDG2
79
MOTFLAG1=0 AND MOTFLAG2=1?
YES
NO
81
CNTREM=INT (((PREWT-WTRDG1)+50)/100)
82
CNTREM>0?
83
SOUND ACK.
84
CNTREM>K1?
86
ALARM=1
SOUND ALARM (FIG. 5)
87
B

ANTI-THEFT PRODUCT RACK AND METHOD

This is a continuation of application Ser. No. 07/157,985, filed Feb. 19, 1988, which in turn is a Rule 60 Continuation Application of application Ser. No. 06/874,159 filed June 13, 1986, both abandoned.

TECHNICAL FIELD

The invention pertains to anti-theft devices and methods for consumer product racks.

BACKGROUND OF THE INVENTION

A fundamental requirement of product display racks used in a retail environment is that they present the product in an aesthetically pleasing and readily accessible manner in order to promote product sales. However, in order to minimize loss of revenue due to shoplifting, the rack should also provide some means of indicating when products have been removed from the rack for the purpose of theft rather than for purchase.

Approaches to the problem of shoplifting from display racks include placing the product behind transparent barriers with apertures that are large enough for the human hand but too small to remove a product displayed in the rack. When a consumer chooses a product, he or she is required to request the aid of a salesperson to unlock the transparent barrier allowing removal of the product. The barrier may present an unacceptable aesthetic impression of the product which will result in lost sales. Also, requiring a customer to request assistance in choosing a product will also result in lost sales.

Often, transparent barriers are provided on display racks which allow stacked products to be removed one at a time from the bottom of the stack. The products are removable only through a slot or the like in the transparent barrier aligned with the bottom of the stack of products. Requiring products to be removed only one at a time clearly discourages multiple product purchases.

Other approaches display products on a rack with the products being captured by a slidable retainer or the like. If the slidable retainer is moved without proper authorization, an electrical circuit is interrupted and an alarm is sounded. Once again, this display rack requires intervention of a salesperson in order to deactivate the alarm system for legitimate product removal.

Therefore, product display racks which provide protection against shoplifting either present an intimidating display by enclosing the product in a protective barrier, or require the intervention of a salesperson to facilitate legitimate removal of product, or both. These anti-theft features combine to necessarily reduce product sales.

SUMMARY OF THE INVENTION

The present invention avoids the above-identified failings by providing a display rack which detects theft while providing absolutely no physical barrier to product removal, and while requiring no saleperson intervention for legitimate product removal.

According to a feature the present invention, the weight of the display rack is monitored and an alarm is sounded if the sensed weight indicates that more than a programmable number of product units have been removed at one time. In addition, an alarm is sounded if the sensed weight indicates that more than a programmable number of product units have been removed from the display rack with a programmable time period.

Also, the present invention is capable of detecting rack tampering such as "swapping" other products for product units in the rack in an attempt to defeat the system. An alarm will occur if the display rack is disturbed continuously for a programmable amount of time, or if a number of unstable episodes not associated with legitimate product removal occur during a programmable time period.

The number of product units that must be removed in order to sound either the instantaneous or periodic alarm is variable, as are the time periods required for periodic removal and for detection of disturbances. Therefore, the present invention is applicable to retain environments having high sales volume or low salts volume by simply reprogramming the various alarm limits.

The fact the rack of the present invention is alarmed at all can be made completely transparent to the consumer because no physical barriers appear between the consumer and the product. In addition, the product is not restrained in any way from removal by a legitimate consumer. Also, intervention of a sales person is not required for the removal of products.

In addition to sounding a local alarm if removal of product units is detected in excess of the programmable limits, the present invention can also sound a remote alarm by wire or radio link. The invention also provides a local acknowledge tone when product units, less in number than the alarm limit, are removed from the rack. The local acknowledge tone notifies the customer that the display is monitored further discouraging theft. The acknowledge tone may be used in addition to or replaced by a synthesized voice which repeats a suitable salutation upon product removal. The local alarm and acknowledge tone or voice may be silenced so that only the remote alarm sounds.

The display rack can be used with a key lock switch which allows the theft prevention feaure of the invention to be disabled for restocking of the rack. The key lock switch may also be used to place the display rack in a lock-up mode in which the display rack will cause an alarm if any disturbance of the rack is sensed. This serves to reduce employee theft during periods when a store is closed but employees are present. Finally, the key lock switch may be used to place the display rack in a normal operating mode.

The key lock switch may be replaced by, or used in addition to, a switch controllable by a real-time clock. The real-time clock controls the switch to modify the various programmable alarm limits, and to automatically place the system in the lock-up mode dependent upon time of day.

The present invention is also applicable to warehouse racks, such as pallets and the like, upon which products are stored. The present invention allows such warehouse racks to be protected from product theft without providing expensive anti-theft measures such a lockable cages, and the like.

It is therefore a primary object of the present invention to provide a rack for consumer product units that reduces loss of revenue due to shoplifting or employee theft, but that does not discourage legitimate product purchases.

It is another object of this invention to prevent consumer product theft from a product rack by monitoring the weight of the rack holding the consumer products, and by providing an indication, such as an alarm, that a number of product units, in excess of a programmable number of units, have been removed from the rack.

It is yet another object of the present invention to provide a consumer product rack that provides an indication, such as an alarm, that a number of product units, in excess of a programmable number of units, have been removed from the rack during a programmable time period.

It is also an object of the present invention to deter "swapping" of other merchandise for product units contained in a consumer product rack by providing an indication, such as an alarm, that the rack has been disturbed continuously for more than a programmable time period, or that the rack has experienced a number of disturbances, in excess of a programmable number of disturbances, during a programmable time period.

These and other objects, features and advantages of the present invention will be seen more clearly by reference to the following detailed specification and to the appended drawings.

DETAILED DESCRIPTION OF THE PREFERRED EMBODIMENT

Figure 1:
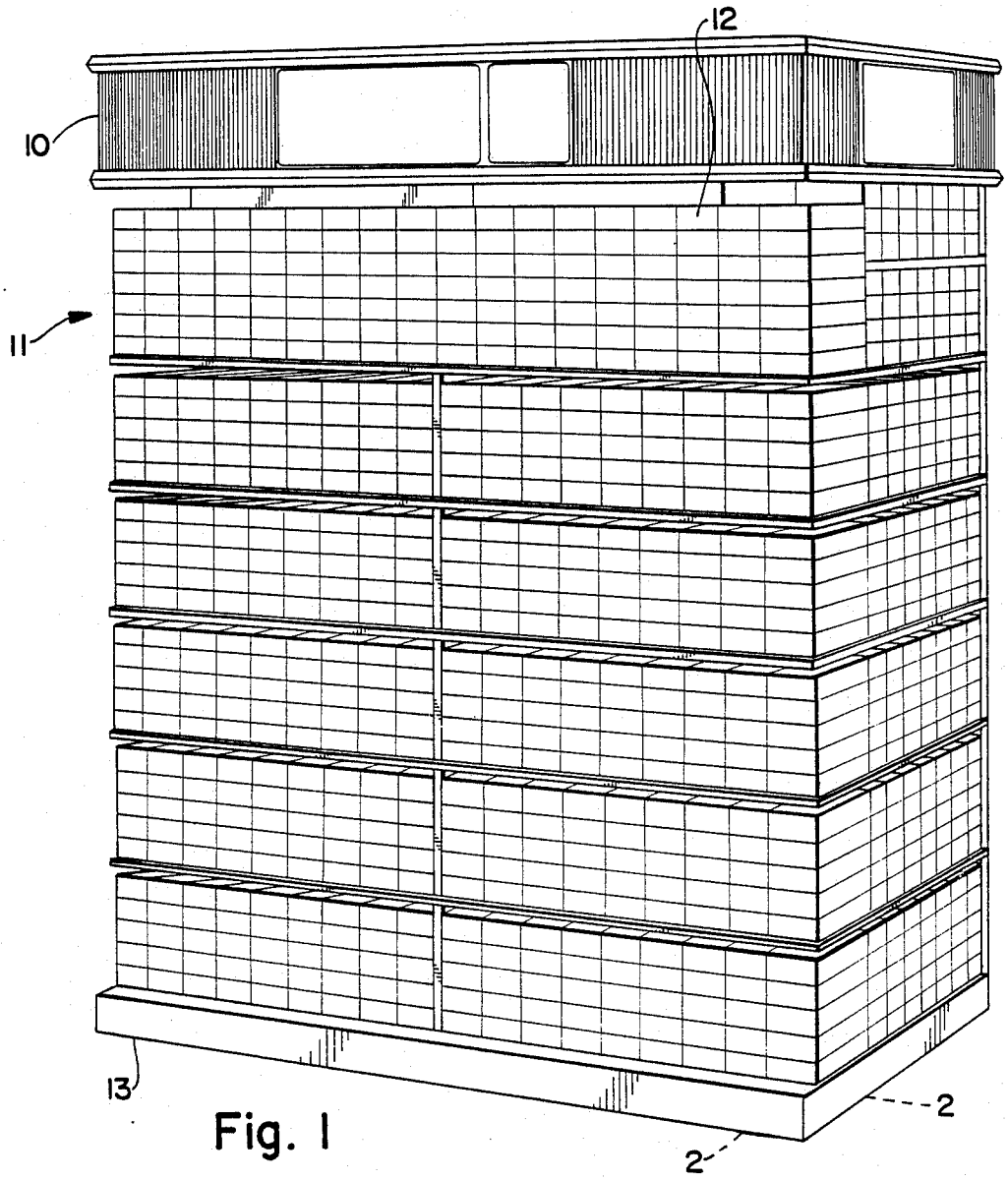
FIG. 1 is an isometric view of a consumer product rack according to the present invention.

Referring to FIG. 1, a consumer product rack 10 according to the present invention is shown. Rack 10 includes a number of individual compartments 11, each compartment holding a plurality of consumer product units 12 such as, for example, cartons of cigarettes. While rack 10 of the preferred embodiment is a display rack intended for placement in a retail establishment, it will be understood that the present invention is equally applicable to other product racks, such as warehouse pallets, and the like. Rack 10 rests on base 13 which is supported by a plurality of feet as shown in detail in FIG. 2.

Figure 2:
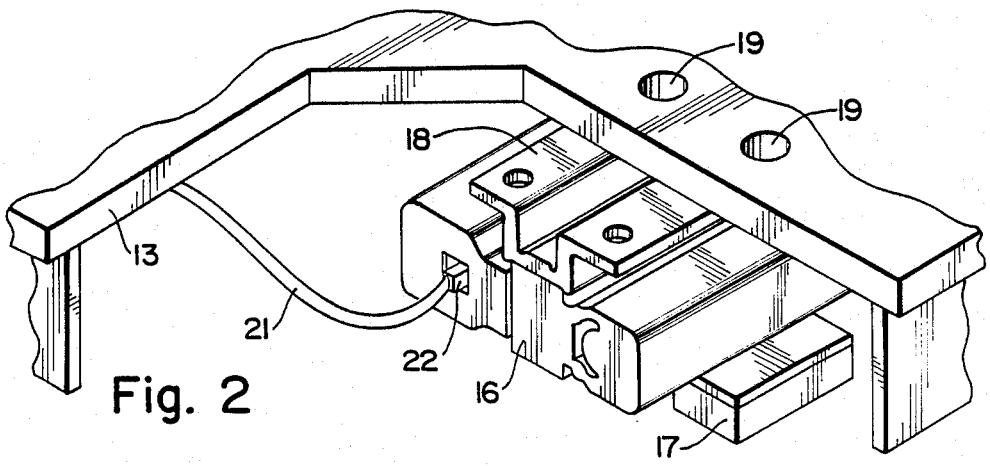
FIG. 2 is a partial sectional view of the base of the rack shown in FIG. 1, showing the mechanical details of a weight sensor used in the present invention.

Referring to FIG. 2, which is a sectional view of a portion of base 13, the detail of the placement of weight transducers used in the present invention is disclosed. Each transducer 16 is placed below a foot 17 and bracket 18. Bracket 18, in turn, is connected to base 13 by appropriate attachment means 19 such as screws or rivets.

In practice, a plurality of weight transducers 16 are placed at a plurality of points beneath base 13 so that the entire weight of rack 10 (FIG. 1) can be accurately sensed by the plurality of weight transducers. Each weight transducer is connected to the weight signal processing circuitry of the present invention (shown in detail in FIG. 3) by conductor 21 and connector 22.

Weight transducers 16 are preferably of the highly accurate vibrating wire-type which produce a voltage signal having a frequency which varies in proportion to the weight sensed by the transducer.

Figure 3:
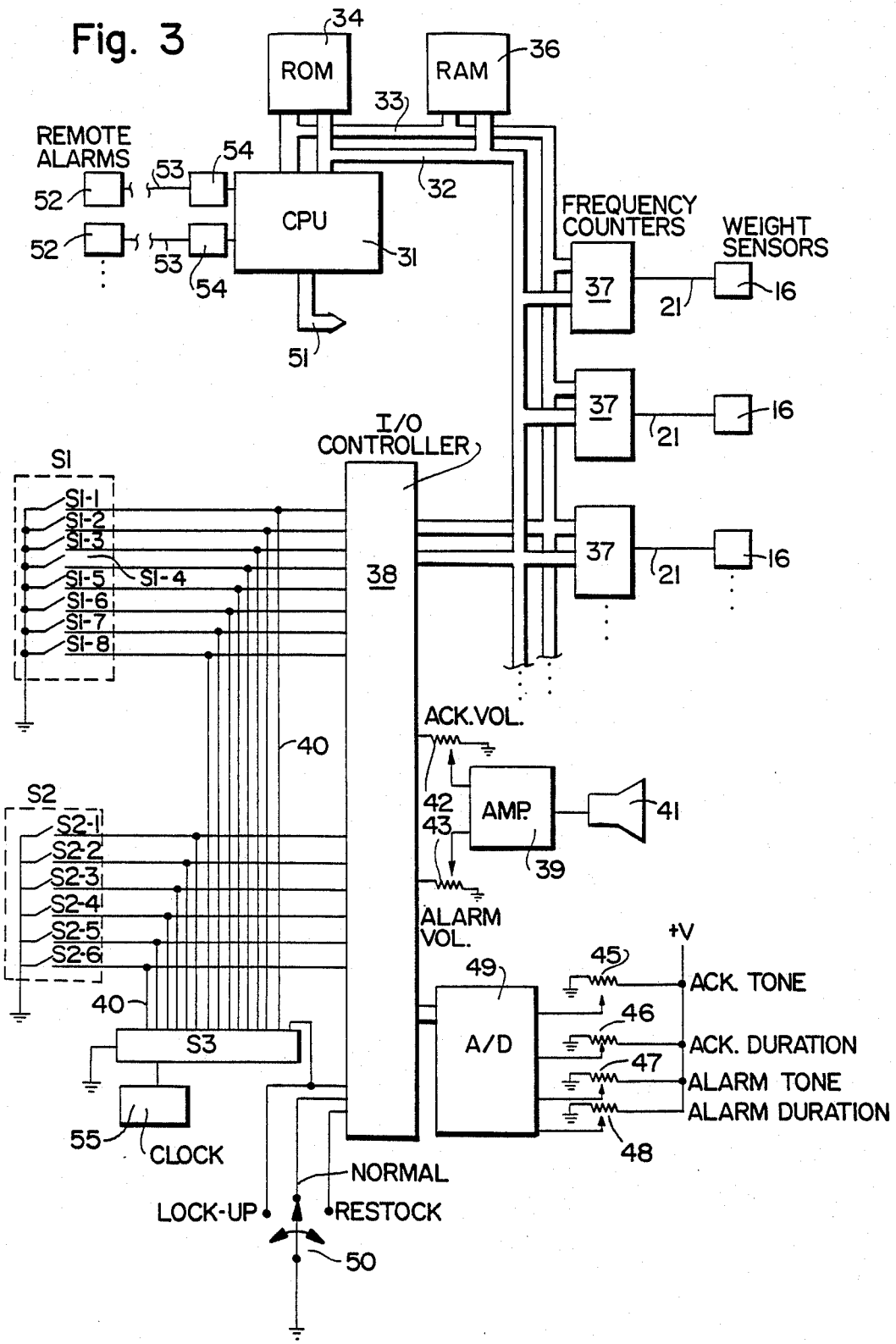
FIG. 3 is a block diagram of the electrical schematic of the present invention.

Referring to FIG. 3, the hardware embodiment of the present invention is shown. The invention uses a central processing unit (CPU) 31 to perform the calculations and to control the various input/output operations of the present invention. Processor 31 can be, for example, a type 8031 microcomputer available from Intel Corporation.

Connected to processor 31 are data bus 32 and address bus 33. Buses 32 and 33 allow processor 31 to communicate with the various other hardware components of the present invention. Processor 31 communicates with read only memory (ROM) 34 and random access memory (RAM) 36. ROM 34 is used to store the control program of the present invention shown in FIGS. 4A–4D and 5, while RAM 36 is used as a scratch pad memory. ROM 34 can also store the synthesized voice of the acknowledge salutation. It should be noted that both ROM 34 and RAM 36 may be located within processor 31, such as, for example, in a type 8051 microcomputer available from Intel Corporation.

The individual weight sensors 16 are connected by conductors 21 to respective frequency counters 37 which, in turn are connected to data bus 32 and address bus 33. The individual frequency counters 37 count the frequency of the voltage produced by respective weight sensors 16, and produce a binary word indicative of sensed weight which is placed on data bus 32 when interrogated by processor 31 via address bus 33. A typical accumulation period for counters 37 is 0.25 seconds. At the end of a particular accumulation period, counters 37 are reset and a new count is begun. Although FIG. 3 shows only three sets of frequency counters and weight sensors, any number of sensors and counters can be used in the present invention. Frequency counters 37 can be, for example, type 8253 frequency counters manufactured by Intel Corporation.

Also connected to data bus 32 and address 33 is input/output controller 38 which can be, for example, a type 8155 controller available from Intel Corporation. Controller 38 is connected to ganged switches S1 and S2 which allow a user of the system to program the system for a specific application. Details of this programmability will be discussed below.

Also connected to controller 38 is amplifier 39 which powers alarm speaker 41. Speaker 41 produces both a local acknowledge tone and a local alarm. Alternatively, a synthesized voice signal may be stored in ROM 34 and may be played instead of, or in addition to, the acknowledge tone. The volume of the acknowledge tone or voice is controlled by potentiometer 42, and the volume of the local alarm signal is controlled by potentiometer 43.

The tone and duration of the acknowledge signal and the local alarm are adjustable by use of potentiometers 45–48. One end of each of potentiometers 45–48 is connected to a voltage source +V, and the other ends are grounded. The wiper of each potentiometer is connected to analog-to-digital converter 49 which, in turn, is connected to controller 38. Analog-to-digital converter 49 can be, for example, a type ADC0844 converter manufactured by National Semiconductor Corporation.

Three position key lock switch 50 is also connected to controller 38. When switch 50 is in a first position, the display rack is in a normal mode with all features active. In a second position, key lock switch 50 disables the theft prevention features of the present invention to allow restocking. Switch 50 can also be positioned in a third position which places the rack in a night lock-up mode. In the night lock-up mode, any disturbance of the rack will cause an alarm.

Processor 31 is also connected to data output bus 51 which can be used to drive a display or printer (not shown) for the purpose of monitoring the weight of the system or monitoring the disturbance activity or purchase activity of the system. Processor 31 is also connectable to remote alarms 52 through individual links 53. Alarms 52 can be located far from the product display rack for remote monitoring of the system. If desired, the local alarm can be reduced to zero volume and the product display rack can be monitored using only remote alarms 52. Once again, it will be understood that while only two alarms 52 are shown in FIG. 3, this disclosure is offered by way of example rather than limitation and any number of remote alarms may be used.

Links 53 are preferably wire or radio link. A preferred radio link may use, for example, a type D-24A transmitter 54 and a type D-67 receiver manufactured by Linear Electronics of Carlsbad, Calif. Since this preferred transmitter 54 is powered by an internal battery and sends a signal when its control contact is open, this allows an alarm signal to be sent to remote alarms 52 when the display rack becomes unpowered or if the connection between processor 31 and links 53 is severed. Links 53 acn also be used to actuate a video camera which will record activity in the vicinity of the protected rack.

If links 53 are wire, elements 54 in FIG. 3 can be appropriate line drivers.

Switches S1, S2 are used by a system operator to manually program various system parameters as described in detail below. The manual settings of switches S1 and S2 may be overriden by contacts within switch S3. Switch S3 is controlled by real-time clock 55. Clock 55, in combination with switch 53 allows one or more of the various parameters to be automatically programmable dependent upon time of day. Clock 55 and switches 53 can also be used to automatically place key-lock switch 50 in the lock-up mode, for example, when a store is closed.

Referring to FIGS. 4A–4D, the individual processing steps of the present invention will be described. After the routine is started, the states of switches S1 and S2 are interrogated and parameters K0, K1, K2, K3 and K5 are set according to the following Tables.

TABLE I

| K0: Weight Limit Instability | |
|---|---|
| SI-7 | Limit (100ths of Units) |
| closed | 30 |
| open | 40 |

TABLE II

| K1: Instantaneous Removal Limit | | | |
|---|---|---|---|
| S1-1 | S1-2 | S1-3 | No. of Product Units |
| closed | closed | closed | 1 |
| open | closed | closed | 2 |
| closed | open | closed | 3 |
| open | open | closed | 4 |
| closed | closed | open | 5 |
| open | closed | open | 6 |
| closed | open | open | 7 |
| open | open | open | 8 |

TABLE III

| K2: Unstable Episode Limit | |
|---|---|
| S1-8 | Limit (consecutive Cycles) |
| closed | 10 |
| open | 20 |

TABLE IV

| K3: Periodic Removal Limit | | | |
|---|---|---|---|
| S1-4 | S1-5 | S1-6 | No. of Product Units |
| closed | closed | closed | 3 |
| open | closed | closed | 4 |
| closed | open | closed | 5 |
| open | open | closed | 6 |
| closed | closed | open | 7 |
| open | closed | open | 8 |
| closed | open | open | 9 |
| open | open | open | 10 |

TABLE V

| K5: Time Period | | | |
|---|---|---|---|
| S2-4 | S2-5 | S2-6 | Time (min.) |
| closed | closed | closed | 1 |
| open | closed | closed | 2 |
| closed | open | closed | 3 |
| open | open | closed | 4 |
| closed | closed | open | 5 |
| open | closed | open | 6 |
| closed | open | open | 7 |
| open | open | open | 8 |

In the present embodiment, parameter K4, which is the periodic unstable episode limit is set equal to 5. However, this limit could also be programmable with the addition of additional switches.

The remaining switches (1–3 of S2) are used to designate the number of weight transducers on a particular display rack. This allows the same theft detection hardware to be applied to various sizes of racks using various numbers of weight transducers. Also, it allows the system to detect if a weight transducer has been disconnected. The number of valid transducers is set according to the following Table.

TABLE VI

| Valid Transducers | | | |
|---|---|---|---|
| S2-1 | S2-2 | S2-3 | Valid Tranducers |
| closed | closed | closed | tone test |
| open | closed | closed | 1 |
| closed | open | closed | 1,2 |
| open | open | closed | 1,2,3 |
| closed | closed | open | 1,2,3,4 |
| open | closed | open | 1,2,3,4,5 |
| closed | open | open | 1,2,3,4,5,6 |
| open | open | open | invalid setting |

When switches S2-1, S2-2 and S2-3 are all closed, the local alarm or voice is turned on thereby allowing the tone and volume to be set as described earlier. When switches S2-1, S2-2 and S2-3 are all open, this state is ignored as an invalid setting. Therefore, according to the preferred embodiment, at least one and up to six weight transducers may used. Once again, this should not be considered a limitation of the present invention. Additional transducers can be obviously accommodated by adding additional switches.

After the parameters are set by interrogation of switches S1 and S2 in block 56, control is transferred to block 57 where the first weight reading, WTRDG1, is taken. The weight is determined by interrogating the individual weight sensor 16 via frequency counters 37 (both shown in FIG. 3), and by summing the individual sensed weights. In this manner, the entire weight of the display rack is sensed. The units of variable WTRDG1 are in 100ths of product units. Therefore the actual weight sensed by sensors 16 must be multiplied by a predetermined factor in order to convert the actual sensed weight into a weight in 100ths of product units. If, when taking weight reading WTGRDG1, the system detects weight signals are being produced by less than the number of transducers set by switches S2-1, S2-2 and S2-3 according to Table VI, an alarm is sounded.

Control is then transferred to block 58 where variables WTRDG2, WTRDG3 and PREWT are all set to WTRDG1.

The program then enters the main loop of the routine beginning with block 59 where, with operation identical to that of block 57, the weight WTRDG1 is again sensed, and it is determined if the number of transducers is less than that indicated by switches S2-1, S2-2 and S2-3 according to Table VI. Control is then transferred to block 61 where cycle counter CYCLCNT is incremented by 1 and counter OLDCYCL is set equal to counter CYCLCNT less K5.

Control is then transferred to motion detection decision blocks 62–64. In these decision blocks, the three stored weight readings WTRDG1, corresponding to the present weight, WTRDG2, corresponding to the last sensed weight, and WTRDG3, corresponding to the penultimate sensed weight, are each subtracted and the differences are compared with parameter K0. If the difference between any two of the sensed weights is greater than parameter K0, flag MOTFLAG1 is set equal to "1" in block 66. Otherwise, flag MOTFLAG1 is set equal to "0" in block 67. Control is then transferred to decision block 68 where the state of MOTFLAG1 is detected. If flag MOTFLAG1 was set in block 66, counter MOTCNT is incremented by 1 in block 69. Otherwise, counter MOTCNT is set to 0 in block 71. Counter MOTCNT keeps track of the number of consecutive cycles wherein motion is detected.

The value of counter MOTCNT is compared with parameter K2 in decision block 72. If counter MOTCNT is greater than parameter K2, indicating that the number of consecutive unstable episodes is greater than the desired limit, control is transferred to block 73 where variable ALARM is set equal to "2", counter MOTCNT is reset in block 74 and the alarm is sounded in block 76 (processing steps described in detail with reference to FIG. 5). This ends the motion detection portion of the routine.

Control is then transferred to decision block 77 where detection of the number of product units removed is begun. In block 78, variable PREWT is set equal to the last sensed weight, WTRDG2, if MOTFLAG1 is equal to "1" and if flag MOTFLAG2 is equal to "0" as determined in decision block 77. In other words, decision block 77 determines if motion is detected during the present cycle when none was detected during the previous cycle.

Control is then transferred to decision block 79 where it is determined if no motion was detected during the present cycle, but that motion was detected during the previous cycle. This is accomplished in decision block 79 which interrogates flags MOTFLAG1 and MOTFLAG2. If true, control is transferred to block 81 where the integer number of product units removed is determined by the rounding formula shown. Using this formula, weights less than 0.49 units are rounded down, weights between 0.50 and 1.49 units are rounded to 1, and so forth. Control is then transferred to decision block 82 where it is determined if any product units were removed. If so, the local acknowledge tone is sounded, or the stored synthesized voice is played back, in block 83 and control is transferred to block 84 to determine if the number of product units removed is greater than parameter K1. In other words, block 84 determines if the detected number of units removed from the rack is greater than the instantaneous removal limit. If so, control is transferred to block 86 where variable ALARM is set equal to "1" and the alarm is sounded in block 87. This ends the instantaneous removal detection portion of the routine.

Control is then transferred to block 88 where the routine for determining the number of unstable episodes occuring during time period K5 is determined. In block 88, counter N is set equal to "0" and control is transferred to a loop beginning with block 89 where counter N is incremented.

In decision block 91, all entries in motion vector MOTPER(N) are discarded if the entries are greater than counter OLDCYCL. Motion vector MOTPER(N) is a time stamp vector in which the individual entries record the cycle number when motion was detected when that motion was determined not to be a removal of an integer number of product units.

By this means, only time stamps less than K5 old are retained in vector MOTPER(N). Counter N is incremented in block 93 and the checking loop is traversed until N equals 10. It should be emphasized that although only 10 time stamps are retained in vector MOTPER(N), this is once again by way of example only and not by way of limitation.

Control is then transferred to decision block 94 where if there has been no motion detected during the present cycle and if there was motion detected during the past cycle, and if the number of product units removed is less than 1, control is transferred to block 95 where counter N is set equal to "0". In the loop beginning with block 96, counter N is incremented and consecutive entries of vector MOTPER(N) are interrogated and determined if equal to 0 in block 97. When the first 0 element is detected, control is transferred to block 98 where the individual element of MOTPER(N) is set equal to the present cycle, CYCLCNT, in block 98 thereby recording a time stamp of the detected motion. The loop including block 97 is not exited unless a zero element is found in vector MOTPER(N), or unless the end of the vector is detected in decision block 99.

Control is then transferred to block 101 where counters Q and N are both set equal to "0" and another checking loop is entered. In this loop, counter N is incremented in block 102 and individual entries of vector MOTPER(N) are interrogated by decision block 103. If an entry is greater than 0, counter Q is incremented by 1 in block 104. The loop is retraced until the end of vector MOTPER(N) is detected in decision block 106. Thus, counter Q is set equal to the number of non-zero entries in motion vector MOTPER(N).

Control is then transferred to decision block 107 where it is determined if counter Q is greater than parameter K4. If so, control is transferred to block 108 where variable ALARM is set equal to "4" and the alarm is sounded in block 109. In other words, the alarm is sounded if counter Q indicates that there has been a number of unstable episodes greater than parameter K4 during a period set by parameter K5. This ends the periodic unstable episode detection portion of the routine.

Control is then transferred to block 111 where counter N is set equal to 0. Block 111 begins a routine which detects the number of product units removed during a time period set by parameter K5.

Figure 4A:
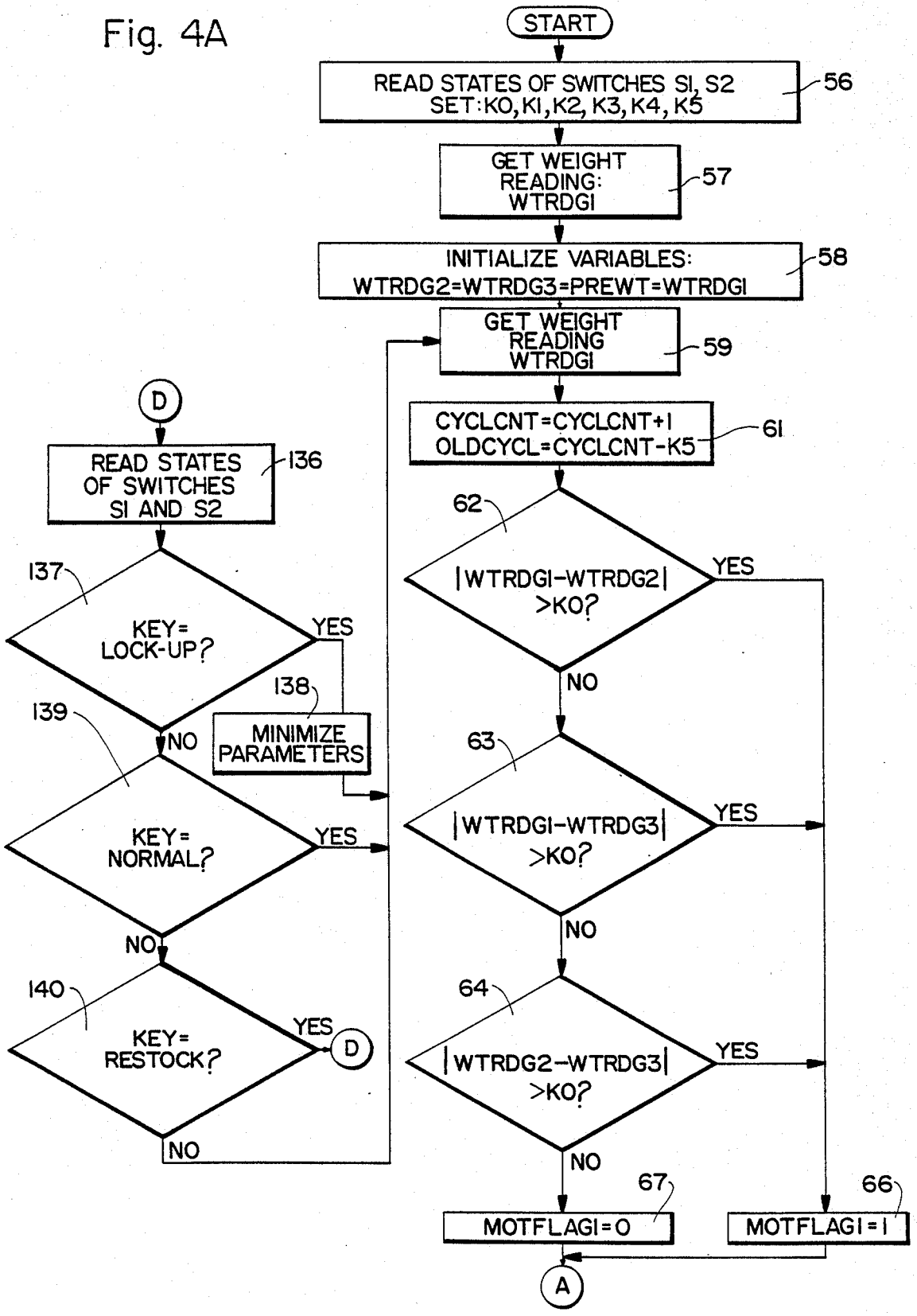
FIGS. 4A–4D are a flow chart detailing the computational steps of the theft detection routine of the present invention.
Figure 4B:
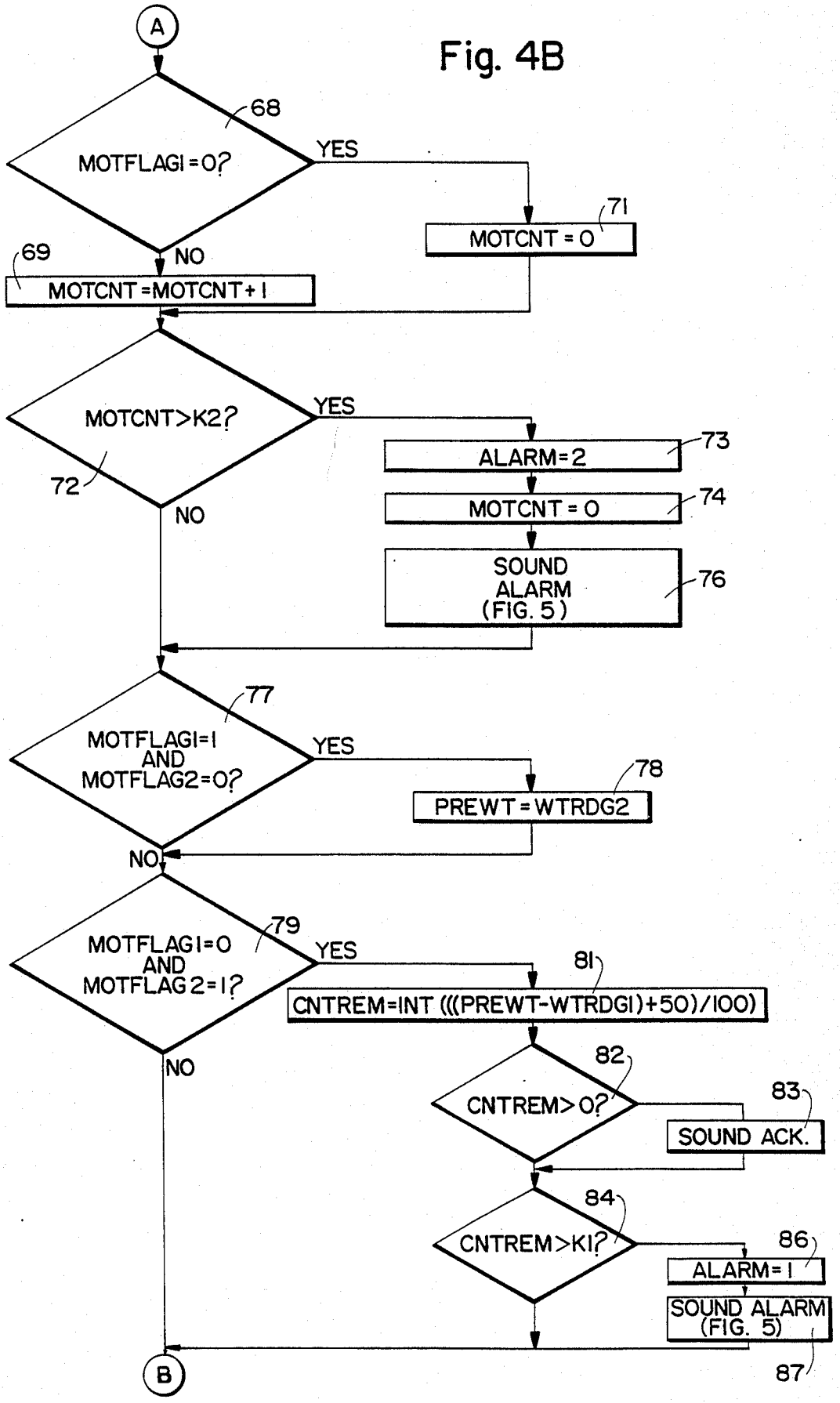
Figure 4C:
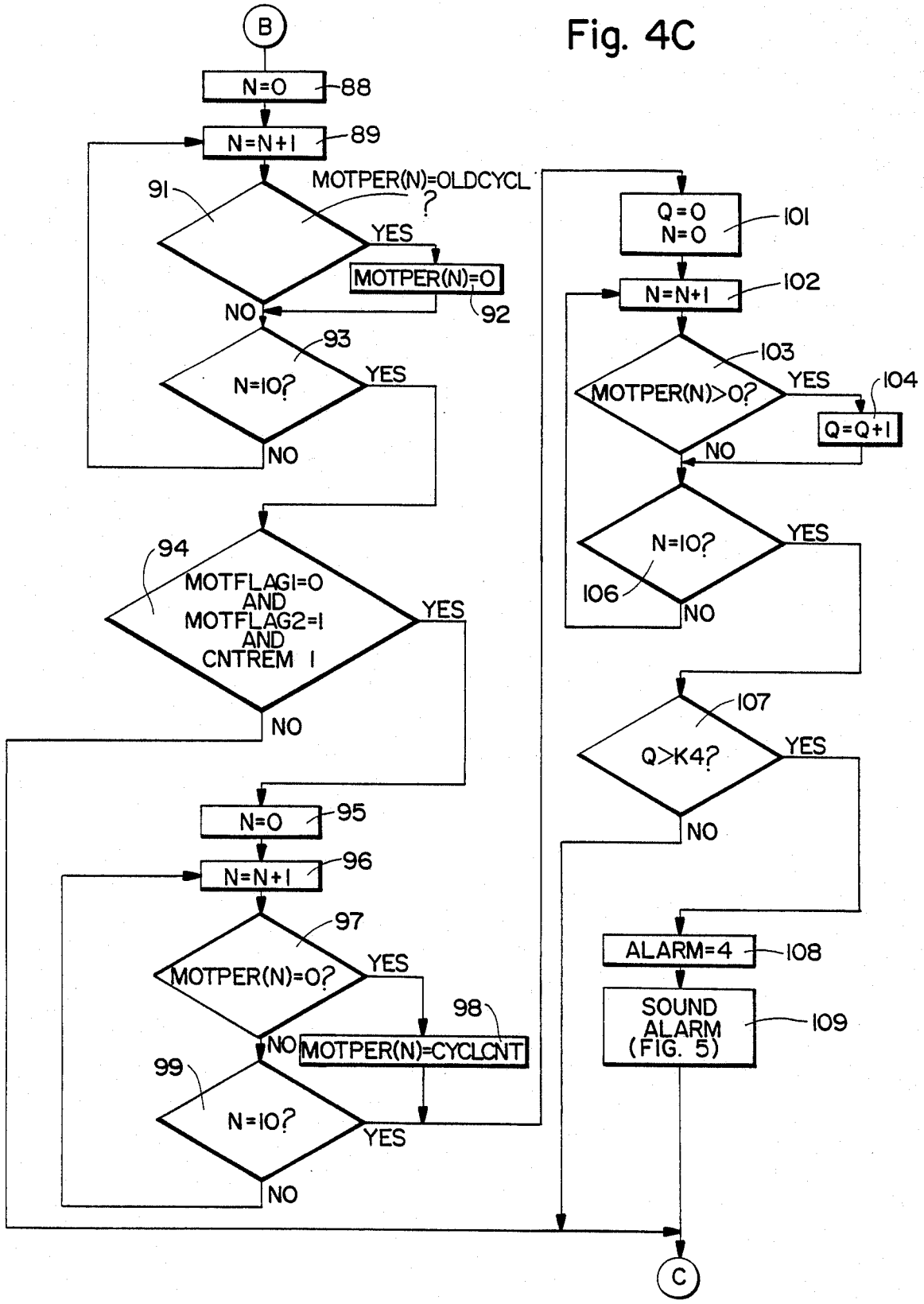
Figure 4D:
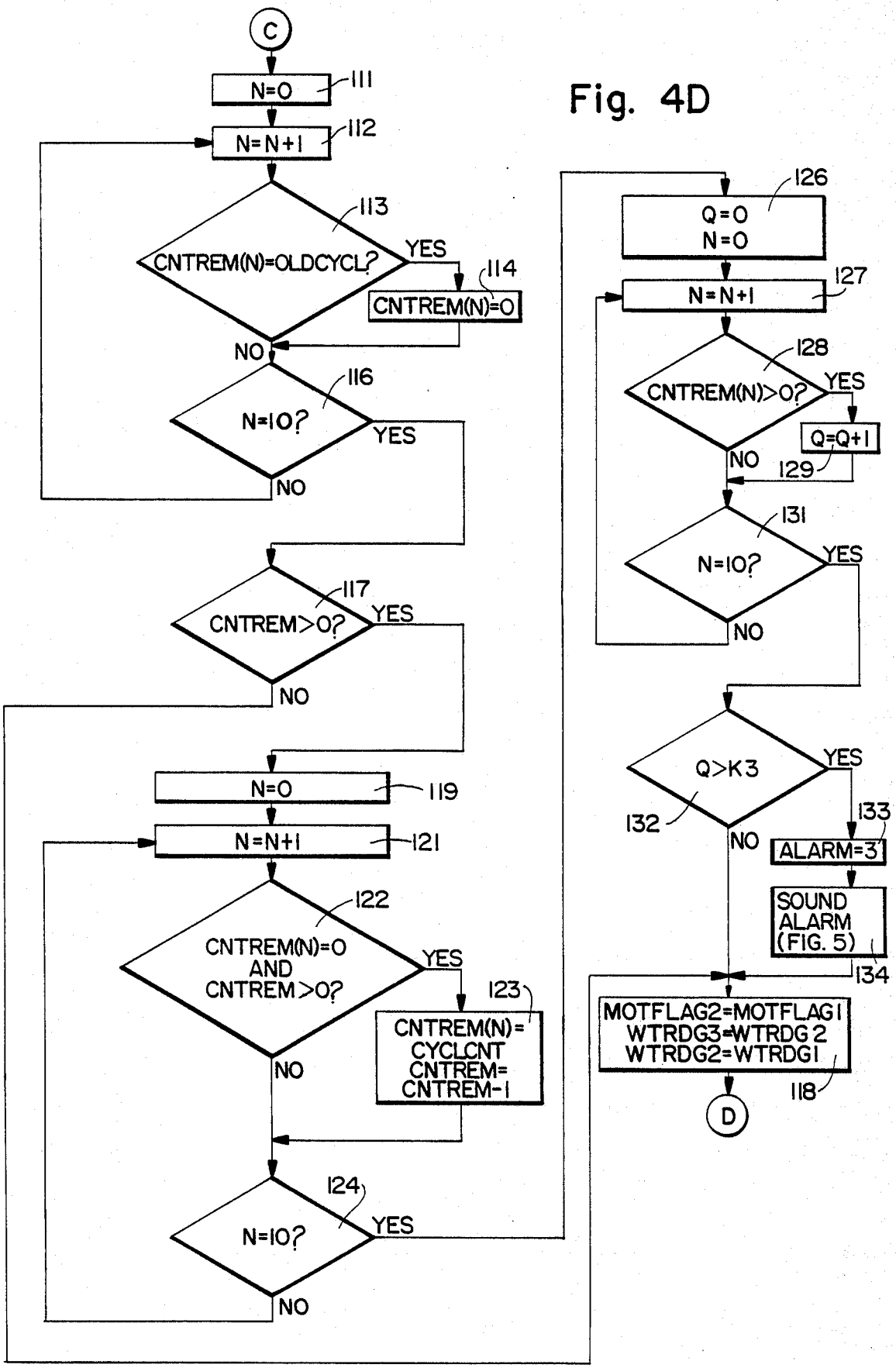

In block 112, counter N is incremented and a loop is started in which the individual entries of counter vector CNTREM(N) that are greater than counter OLDCYCL (as determined by decision block 113), are set equal to 0 in block 114. Count vector CNTREM(N), similar in format to motion vector MOTPER(N), is a time stamp vector in which the individual entries record the cycle number when each product unit was removed. The loop is retraced until all entries of vector CNTREM(N) have been interrogated as determined by decision block 116. After this loop, all entries of counter vector CNTREM(N) will be set to 0 if the counts are equal to counter OLDCYCL (i.e., older than time period K5). In decision block 117 it is determined if any product units have been removed by interrogation of counter CNTREM. If not, no further action is taken and control is transferred to block 118 (FIG. 4D). If true, control is transferred to block 119 where counter N is set equal to "0" and a loop is begun with block 121 where counter N is incremented.

In the loop beginning with block 121, count vector CNTREM(N) is interrogated for 0 entries in block 122, and counter CNTREM is compared with "0". If a zero entry is detected and if CNTREM is greater than zero, control is transferred to block 123 where the vector entry detected as 0 in block 122 is set equal to counter CYCLCNT, and counter CNTREM is decremented by 1. The interrogation loop is continued until decision block 124 determines that the last entry in count vector CNTREM(N) has been interrogated. As a result of this loop, time stamps equal to the present cycle counter are entered into vector CNTREM(N) for each product unit removed. It should be noted that if more than one product unit is detected as being removed during a single cycle, several of the entries in count vector CNTREM(N) will have the same value.

Control is then transferred to block 126 where counter Q and N are both reset. In block 127, counter N is incremented and a loop is begun wherein the individual entries of counter vector CNTREM(N) are interrogated in decision block 128. For each non-zero entry in vector CNTREM(N), counter Q is incremented by 1 in block 129. The loop is retraced until decision block 131 determines that each element of vector CNTREM(N) has been interrogated. As a result of this loop, counter Q indicates the number of non-zero entries in count vector CNTREM(N).

In decision block 132, counter Q is compared with parameter K3 to determine if the periodic unit removal limit has been exceeded. If so, variable ALARM is set equal to "3" in block 133 and the alarm is sounded in block 134. Control is then transferred to block 118 where the flag MOTFLAG2 is updated as are weight readings WTRDG3 and WTRDG2. Control is then transferred back to block 136 (FIG. 4A) where the loop is once again begun.

Referring back to FIG. 4A, in block 136, which operates identically to block 56, the states of switches S1 and S2 are again sensed. This is in order to detect any changes in the states of switches 51 or 52 under action of switch 53 (FIG. 3).

Next decision blocks 137, 139 and 140 are used to detect the position of key-lock switch 50 (FIG. 3). If key lock switch 50 is in the lock-up mode (or if switch 53 has placed keylock switch 50 in the lock-up mode), block 137 directs control to block 138 where appropriate parameters are minimized in order to place the rack at its highest theft prevention sensitivity. Control is then transferred to block 59 where the entire loop is retraced.

If block 139 does not detect lock-up, control is transferred to block 138 where normal mode is detected. If key lock switch 50 is in the normal mode position, control is transferred to block 59, and the loop is retraced.

If block 139 decides key lock switch 50 is not in the normal mode, control is transferred to decision block 140 where, if key lock switch 50 is in the restock mode, block 136 is again reentered without retracing the main loop. Otherwise, the main loop is retraced by entering block 59.

Figure 5:
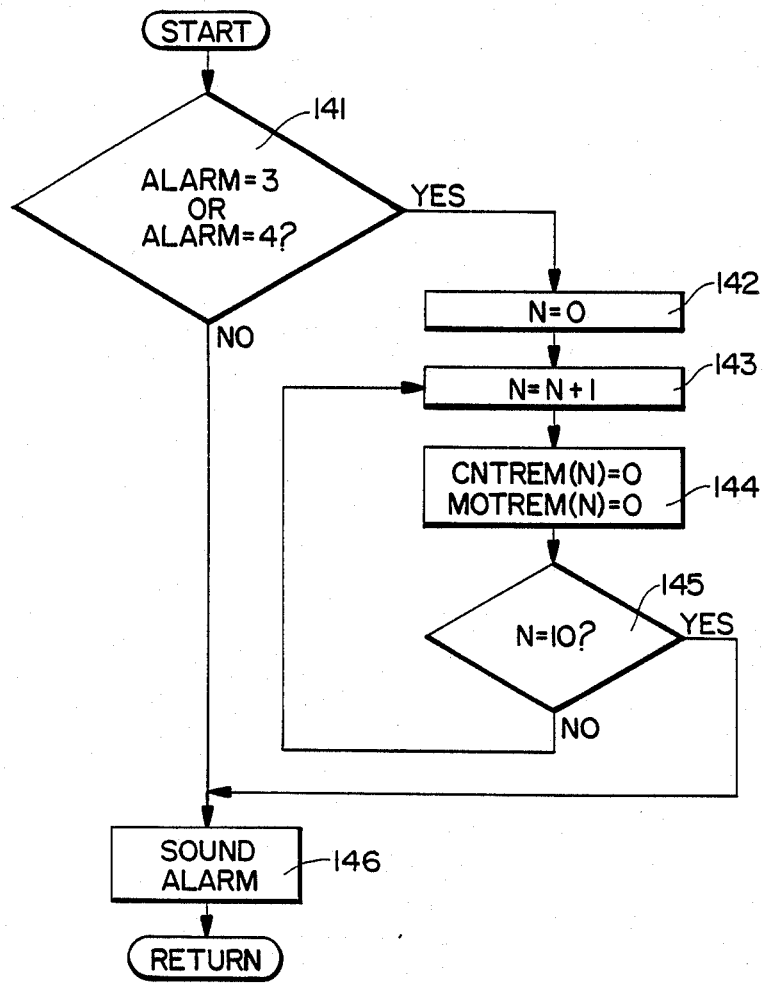
FIG. 5 is a flow chart of the computational steps of the alarm routine of the present invention.

Referring now to FIG. 5, the alarm routine will be described. In block 141, it is determined if variable ALARM is equal to "3" or "4". If not, control is transferred immediately to block 146. If so, counter N is reset in block 142, and a loop comprising blocks 143–145 is traversed a sufficient number of times to reset all entries of vectors CNTREM(N) and MOTPER(N). Then the alarm is sounded in block 146.

In summary, switches S2-1, S2-2 and S2-3 are positioned by the user of the system as shown in Table VI to accommodate the number of weight transducers in the rack in use. Parameter K1, the instantaneous removal limit, is set by positioning switches S1-1, S1-2 and S1-3 as shown in Table II, and is variable from 1 to 8 product units.

Switches S1-4, S1-5 and S1-6 are used to set the number of product units which must be removed over a time period to cause an alarm. This is called the periodic removal limit, K3, and is adjustable from 3 to 10 product units as shown in Table IV. The time period, K5, for the periodic removal limit is set by positioning switches S2-4, S2-5 and S2-6, as shown in Table V. In addition, an alarm will sound if the display rack is disturbed continuously for a number of cycles settable by switch S1-8 (parameter K2) as shown in Table III. Finally, rack tampering or "swapping" of other merchandise for product units contained in the rack is detected if five unstable episodes (parameter K4) occur within the time period set by parameter K5.

The product rack will acknowledge removal of product units (when not in excess of an alarm limit) by an adjustable local tone or synthesized voice which can be set to zero volume. The separately adjustable local alarm tone can also be set to zero volume if local alarm is not desired. The alarm signal can be transmitted to a remote receiver, over wire or radio link, which will sound an alarm at a remote location. The local tones are both adjustable in volume, tone and duration.

A principal factor in determining how restrictive the various programmable alarm criteria for periodic removal should be is the extent to which legitimate purchases cause false alarms. This would of course occur during peak traffic hours. The following is a table displaying the results of a computer simulation which was based on the following assumptions:

1. During peak traffic hours, ten customers remove one product unit and five customers remove two product units for total sales of 20 product units during a peak hour.

2. The purchases occur at random times.

3. The predicted false alarm rate is the number of false alarms which would occur during 200 such peak hours.

TABLE VII

| Alarm Limit | Predicted False Alarms Per 200 Peak Hours | | | | | | | |
|---|---|---|---|---|---|---|---|---|
| | Time Period K5 | | | | | | | |
| K1 | 1 | 2 | 3 | 4 | 5 | 6 | 7 | 8 |
| 3 | 5 | 13 | 17 | | | | | |
| 4 | 5 | 12 | 17 | 29 | | | | |
| 5 | 1 | 1 | 1 | 6 | 8 | 10 | 12 | 16 |
| 6 | 1 | 1 | 3 | 5 | 8 | 10 | 12 | 16 |
| 7 | 0 | 0 | 0 | 0 | 2 | 4 | 5 | 6 |
| 8 | 0 | 0 | 0 | 0 | 2 | 4 | 5 | 6 |
| 9 | 0 | 0 | 0 | 0 | 1 | 2 | 3 | 3 |
| 10 | 0 | 0 | 0 | 0 | 1 | 2 | 3 | 3 |

It should be noted that odd numbered settings for the product unit alarm limit permit more restrictive settings without significantly higher incidence of false alarms. When time period and alarm limit settings are restricted to the lowest values which do not cause intolerable false alarm activity, the maximum protection against shoplifting is afforded. While theft of very few product units over an extended period of time may go undetected because this mimics plausible normal activity, the monetary loss of this type of theft is minimal.

While the present invention has been described with reference to a particular preferred embodiment, the invention is not limited to the specific example given, and other embodiments and modifications can be made by those skilled in the art without departing from the spirit and scope of the invention.

What is claimed is:

1. A method of indicating removal of product units from a product unit rack including the steps of:
   monitoring a weight of said rack;
   detecting a change in said weight;
   calculating a number of product units removed from said rack corresponding to said change in weight;
   providing an indication of unauthorized removal if said number of product units is greater than a limit; and
   generating an acknowledgement of authorized removal if said number of product units removed from said rack is greater than zero and less than or equal to said limit.

2. A method according to claim 1, wherein said indication is an alarm.

3. A method according to claim 2, wherein said alarm is a local alarm audible in a vicinity of said rack.

4. A method according to claim 2, wherein said alarm is a remote alarm audible at a location remote from said rack.

5. A method according to claim 4, further comprising the step of:
   transmitting said indication to said remote location over a wire.

6. A method according to claim 4, further comprising the step of:
   transmitting said indication to said remote location by radio link.

7. A method according to claim 1, further comprising the steps of:
   locking said rack in a restock mode wherein at least said step of providing an indication is bypassed; and
   locking said rack in a normal mode wherein said step of providing an indication is performed.

8. A method according to claim 1, wherein said acknowledgement is a tone.

9. A method according to claim 1, wherein said acknowledgement is a synthesized voice.

10. A method of indicating removal of product units from a product unit rack including the steps of:
   monitoring the weight of said rack;
   detecting changes in said weight;
   calculating a number of product units removed from said rack corresponding to each said change; and
   providing an indication of removal if a sum of said number of product units is greater than a limit during a time period.

11. The method according to claim 10, wherein said indication is an alarm.

12. A method according to claim 11, wherein said alarm is a local alarm audible in a vicinity of said rack.

13. A method according to claim 11, wherein said alarm is a remote alarm audible at a location remote from said rack.

14. A method according to claim 13 further comprising the step of:
   transmitting said indication to said remote location over a wire.

15. A method according to claim 13 further comprising the step of:
   transmitting said indication to said remote location by radio link.

16. A method according to claim 10 further comprising the steps of:
   locking said rack in a restock mode wherein at least said step of providing an indication is bypassed; and
   locking said rack in a normal mode wherein said step of providing an indication is performed.

17. A method of indicating disturbance of a product rack containing product units including the steps of:
   monitoring the weight of said rack;
   detecting changes in said weight;
   determining a number of weight changes which are less in magnitude than a weight change corresponding to removal of a product unit;
   providing an indication of disturbance if said number is greater than a limit during a time period.

18. A method according to claim 17, wherein said indication is an alarm.

19. A method according to claim 18, wherein said alarm is a local alarm audible in a vicinity of said rack.

20. A method according to claim 18, wherein said alarm is a remote alarm audible at a location remote from said rack.

21. A method according to claim 20 further comprising the step of:
   transmitting said indication to said remote location over a wire.

22. A method according to claim 20 further comprising the step of:
   transmitting said indication to said remote location by radio link.

23. A method according to claim 17 further comprising the steps of:
   locking said rack in a restock mode wherein at least said step of providing an indication is bypassed; and
   locking said rack in a normal mode wherein said step of providing an indication is performed.

24. A method of indicating disturbance of a product rack containing product units including the steps of:

consecutively sampling the weight of said rack;
calculating differences between said consecutive samples;
providing an indication of disturbance if a successive number of differences, greater than a limit number, are each greater than a first threshold and less than a second threshold.

25. The method according to claim 24, wherein said indication is an alarm.

26. A method according to claim 25, wherein said alarm is a local alarm audible in a vicinity of said rack.

27. A method according to claim 25, wherein said alarm is a remote alarm audible at a location remote from said rack.

28. A method according to claim 27 further comprising the step of:
transmitting said indication to said remote location over a wire.

29. A method according to claim 27 further comprising the step of:
transmitting said indication to said remote location by radio link.

30. A method according to claim 24 further comprising the steps of:
locking said rack in a restock mode wherein at least said step of providing an indication is bypassed; and
locking said rack in a normal mode wherein said step of providing an indication is performed.

31. A method according to claim 24, wherein said second threshold is a weight change corresponding to removal of a product unit.

32. An anti-theft apparatus for use in a product unit rack, or the like, including:
means for measuring a weight of a group of product units;
means for detecting a change in said weight;
means for calculating a number of product units removed from said group according to a magnitude of said change;
means for indicating theft if said number of product units removed exceeds a limit; and
means for acknowledge legitimate removal if said number of product units removed is greater than zero and less than or equal to said limit.

33. A rack according to claim 32 further comprising:
means for locking said rack in a first mode wherein said means for indicating theft is disabled, and for locking said rack in a second mode wherein said means for indicating theft is enabled.

34. A rack according to claim 33, wherein said means for locking is a key lock switch.

35. An anti-theft apparatus for use in a product unit rack, or the like, including:
means for measuring a weight of a group of product units;
means for detecting changes in said weight;
means for calculating a number of product units removed from said group for each said change according to a magnitude of each said change;
means for calculating a sum of said numbers of product units for each said change occurring during a time period; and
means for indicating theft if said sum is greater than a limit.

36. An anti-theft apparatus for use in a product unit rack, or the like, including:
means for measuring a weight of a group of product units;
means for detecting changes in said weight;
means for detecting a number of weight changes having magnitudes less than a predetermined value, said predetermined value corresponding to removal of one product unit from said group;
means for indicating product unit theft if said number is greater than a limit during a time period.

37. An apparatus for detecting theft of product units from a group of product units comprising:
means for sampling a weight of a group of product units at a substantially constant rate;
means for calculating differences between successive weight samples;
means for indicating theft of product units from said group if a number of said differences between successive weight samples exceeds a limit.

38. A method of indicating unauthorized removal of product units from a product unit rack including the steps of:
monitoring a weight of said rack;
detecting a disturbance of said rack, according to monitored weight;
calculating a number of product units removed from said rack corresponding to a difference in monitored weights before and after said disturbance; and
providing an indication of unauthorized removal if said number of product units removed from said rack is greater than a programmable limit.

39. A method according to claim 38, wherein said indication is an alarm.

40. A method according to claim 39, wherein said alarm is a local alarm audible in a vicinity of said rack.

41. A method according to claim 39, wherein said alarm is a remote alarm audible at a location remote from said rack.

42. A method according to claim 41 further comprising the step of:
transmitting said indication to said remote location over a wire.

43. A method according to claim 41 further comprising the step of:
transmitting said indication to said remote location by radio link.

44. A method according to claim 38 further comprising the steps of:
locking said rack in a restock mode wherein at least said step of providing an indication is bypassed; and
locking said rack in a normal mode wherein said step of providing an indication is performed.

45. A method according to claim 38 further comprising the step of:
locking said rack in a lock-up mode wherein said programmable limit is set to a predetermined minimum.

46. A method according to claim 45 further comprising the step of:
selectively activating and deactivating said locking step.

47. A method according to claim 46, wherein said step of selectively activating and deactivating is controlled manually.

48. A method according to claim 46, wherein said step of selectively activating and deactivating is controlled automatically by a real-time clock.

49. A method of indicating removal of product units from a product unit rack including the steps of:
monitoring a weight of said rack;

detecting changes in said weight;

calculating a number of product units removed from said rack corresponding to each said change; and providing an indication of removal if a sum of said number of product units is greater than a programmable limit during a programmable time period.

50. The method according to claim 49, wherein said indication is an alarm.

51. A method according to claim 50, wherein said alarm is a local alarm audible in a vicinity of said rack.

52. A method according to claim 50, wherein said alarm is a remote alarm audible at a location remote from said rack.

53. A method according to claim 52 further comprising the step of:

transmitting said indication to said remote location over a wire.

54. A method according to claim 52 further comprising the step of:

transmitting said indication to said remote location by radio link.

55. A method according to claim 49 further comprising the steps of:

locking said rack in a restock mode wherein at least said step of providing an indication is bypassed; and locking said rack in a normal mode wherein said step of providing an indication is performed.

56. A method according to claim 49 further comprising the step of:

locking said rack in a lock-up mode wherein said programmable limit is set to a predetermined minimum.

57. A method according to claim 56 further comprising the step of:

selectively activating and deactivating said locking step.

58. A method according to claim 57, wherein said step of selectively activating and deactivating is controlled manually.

59. A method according to claim 57, wherein said step of selectively activating and deactivating is controlled automatically by a real-time clock.

60. A method of indicating disturbance of a product rack containing product units including the steps of:

monitoring a weight of said rack;

detecting changes in said weight;

determining a number of weight changes which are less in magnitude than a weight change corresponding to removal of a product unit;

providing an indication of disturbance if said number is greater than a programmable limit during a programmable time period.

61. A method according to claim 60, wherein said indication is an alarm.

62. A method according to claim 61, wherein said alarm is a local alarm audible in a vicinity of said rack.

63. A method according to claim 61, wherein said alarm is a remote alarm audible at a location remote from said rack.

64. A method according to claim 63 further comprising the step of:

transmitting said indication to said remote location over a wire.

65. A method according to claim 63 further comprising the step of:

transmitting said indication to said remote location by radio link.

66. A method according to claim 60 further comprising the steps of:

locking said rack in a restock mode wherein at least said step of providing an indication is bypassed; and locking said rack in a normal mode wherein said step of providing an indication is performed.

67. A method according to claim 60 further comprising the step of:

locking said rack in a lock-up mode wherein said programmable limit is set to a predetermined minimum.

68. A method according to claim 67 further comprising the step of:

selectively activating and deactivating said locking step.

69. A method according to claim 68, wherein said step of selectively activating and deactivating is controlled manually.

70. A method according to claim 68, wherein said step of selectively activating and deactivating is controlled automatically by a real-time clock.

71. A method of indicating disturbance of a product rack containing product units including the steps of:

consecutively sampling a weight of said rack;

calculating differences between consecutive weight samples;

providing an indication of disturbance if a successive number of differences, greater than a programmable limit, are each greater than a first threshold and less than a second threshold.

72. The method according to claim 71, wherein said indication is an alarm.

73. A method according to claim 72, wherein said alarm is a local alarm audible in a vicinity of said rack.

74. A method according to claim 72, wherein said alarm is a remote alarm audible at a location remote from said rack.

75. A method according to claim 74 further comprising the step of:

transmitting said indication to said remote location over a wire.

76. A method according to claim 74 further comprising:

transmitting said indication to said remote location by radio link.

77. A method according to claim 71 further comprising the steps of:

locking said rack in a restock mode wherein at least said step of providing an indication is bypassed; and locking said rack in a normal mode wherein said step of providing an indication is performed.

78. A method according to claim 71 further comprising the step of:

locking said rack in a lock-up mode wherein said programmable limit is set to a predetermined minimum.

79. A method according to claim 78 further comprising the step of:

selectively activating and deactivating said locking step.

80. A method according to claim 79, wherein said step of selectively activating and deactivating is controlled manually.

81. A method according to claim 79, wherein said step of selectively activating and deactivating is controlled automatically by a real-time clock.

82. A method according to claim 71, wherein said second threshold is a weight change corresponding to removal of a product unit.

83. A method of indicating theft of product units from a product unit rack including the steps of:

monitoring a weight of said rack including said product units;

detecting changes in said weight;

calculating a number of product units removed corresponding to each said change;

providing a first indication of theft if said number of product units removed is greater than a first limit;

providing a second indication of theft if, during a first time period, said number of product units removed is greater than a second limit;

providing a third indication of theft if a number of consecutive detected weight changes, not corresponding to product unit removal, exceeds a third limit; and providing a fourth indication of theft if a number of detected weight changes, not corresponding to product unit removal, exceeds a fourth limit during a second time period.

84. A method according to claim 83 further comprising the step of:

generating an audible acknowledgement if said number of product units removed is greater than zero and less than or equal to said first limit.

85. A method according to claim 84, wherein said acknowledgement is a tone.

86. A method according to claim 84, wherein said acknowledgement is a synthesized voice.

87. A method according to claim 83 further comprising the steps of:

sounding at least one alarm in response to said first, second, third or fourth indications of theft.

88. A method according to claim 87, wherein at least one of said at least one alarm is a remote alarm audible at a location remote from said rack.

89. A method according to claim 87, wherein at least one of said at least one alarm is a local alarm audible in a vicinity of said rack.

90. A method according to claim 83 further comprising the steps of:

locking said rack in a restock mode wherein said steps of monitoring, detecting and calculating, and said steps of providing said first, second, third and fourth indications are not performed; and locking said rack in a normal mode wherein said steps of monitoring, detecting and calculating, and said steps of providing said first, second, third and fourth indications of theft are performed.

91. A method according to claim 83 further comprising the step of:

locking said rack in a lock-up mode wherein at least one of said first, second, third and fourth limits is set to a predetermined minimum.

92. A method according to claim 91, wherein said locking step is manually controllable by a rack operator.

93. A method according to claim 91, wherein said locking step is automatically controllable according to a time of a real-time clock.

94. An anti-theft product unit rack comprising:

a weight sensor for sensing a weight of said rack including said product units:

means for detecting changes in said weight;

means for calculating a number of product units removed from said rack for each detected change in weight;

means for indicating theft if said calculated number for a given change is greater than a first limit;

means for calculating a sum of numbers of product units removed for a series of said detected changes in weight;

means for indicating theft if said sum is greater than a second limit during a time period.

95. A rack according to claim 94 further comprising:

means for locking said rack in a first mode wherein each of said means for indicating theft is disabled, for locking said rack in a second mode wherein each of said means for indicating theft is enabled, and for locking said rack in a third mode wherein at least one of said first and second limits is set to a predetermined minimum.

96. A rack according to claim 95, wherein said means for locking is a key lock switch.

97. A rack according to claim 95 further comprising:

a real-time clock for selectively activating and deactivating said means for locking according to a time of said clock.

98. A rack according to claim 94 further comprising:

means for locking said rack in a mode wherein at least one of said first and second limits is set to a predetermined minimum.

99. A rack according to claim 98, wherein said means for locking is a manual key lock switch.

100. An anti-theft product unit rack comprising:

means for sensing a weight of said rack including said product units;

means for detecting changes in said weight;

means for calculating respective magnitudes of said detected changes;

means for calculating a number of product units removed from said rack corresponding to each said change according to a respective magnitude;

means for providing an indication of theft if said number of product units for a change exceeds a first limit;

means for providing an indication of theft if a sum of numbers of product units for changes occurring during a first time period exceeds a second limit; and means for providing an indication of theft if a number of weight changes, having a respective magnitude indicating removal of no product units, exceeds a third limit during a second time period.

101. An anti-theft apparatus for use in a product unit rack, or the like, including:

means for measuring a weight of a group of product units;

means, responsive to said means for measuring, for detecting disturbance of said group of product units;

means, responsive to said means for detecting disturbance, for calculating a number of product units removed from said group according to a difference between a measured weight of said group before a detected disturbance and a measured weight of said group after said detected disturbance; and means for indicating theft if said number of product units removed from said group exceeds a limit.

102. An anti-theft apparatus for use in a product unit rack, or the like, including:

means for measuring a weight of a group of product units;

means for detecting changes in said weight;

means for calculating a number of product units removed from said group for each said change according to a magnitude of each said change;

means for calculating a sum of said numbers of product units for each said change occurring during a programmable time period; and means for indicating theft if said sum is greater than a programmable limit.

103. An anti-theft apparatus for use in a product unit rack, or the like, including:

means for measuring a weight of a group of product units;

means for detecting changes in said weight;

means for detecting a number of weight changes having magnitudes less than a predetermined value, said predetermined value corresponding to removal of one product unit from said group; and means for indicating product unit theft if said number is greater than a programmable limit during a programmable time period.

104. An apparatus for detecting theft of product units from a group of product units comprising:

means for sampling a weight of a group of product units at a substantially constant rate;

means for calculating differences between successive weight samples;

means for indicating theft of product units from said group if a number of said differences between successive weight samples exceeds a programmable limit.

* * * * *